US010302256B2

(12) United States Patent
Kwon et al.

(10) Patent No.: US 10,302,256 B2
(45) Date of Patent: May 28, 2019

(54) LIGHTING APPARATUS AND LIGHTING SYSTEM

(71) Applicant: Samsung Electronics Co., Ltd, Gyeonggi-do (KR)

(72) Inventors: Young-kwang Kwon, Gyeonggi-do (KR); Joo-hun Han, Gyeonggi-do (KR); Bang-won Oh, Seoul (KR); Du-su Kwon, Gyeonggi-do (KR); Hyun-kyung Kim, Gyeonggi-do (KR); Yoon-ki Park, Seoul (KR); Yoon-suk Lee, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 15/132,166

(22) Filed: Apr. 18, 2016

(65) Prior Publication Data

US 2016/0312961 A1 Oct. 27, 2016

Related U.S. Application Data

(63) Continuation of application No. PCT/KR2014/009771, filed on Oct. 17, 2014.

(30) Foreign Application Priority Data

Oct. 18, 2013 (KR) ..... 10-2013-0124656

(51) Int. Cl.
*F21K 9/272* (2016.01)
*F21K 9/275* (2016.01)
(Continued)

(52) U.S. Cl.
CPC ..... *F21K 9/275* (2016.08); *F21K 9/272* (2016.08); *F21V 3/00* (2013.01); *F21V 3/02* (2013.01);
(Continued)

(58) Field of Classification Search
CPC . F21K 9/275; F21K 9/272; F21K 9/27; F21K 2103/10; F21V 29/70; F21V 29/83;
(Continued)

(56) References Cited

U.S. PATENT DOCUMENTS 6,882,111 B2 * 4/2005 Kan ..... G09F 13/22 362/219
7,556,411 B2 7/2009 Wu et al.
(Continued)

FOREIGN PATENT DOCUMENTS

CN 203115604 U 8/2013
JP 3173660 B2 6/2001
(Continued)

OTHER PUBLICATIONS

International Search Report dated Jan. 27, 2015 in connection with International Patent Application No. PCT/KR2014/009771, 3 pages.
(Continued)

*Primary Examiner* — Y M. Lee

(57) ABSTRACT

A lighting apparatus including a plurality of frames connected to each other in the lengthwise direction; a connector, which is arranged between the plurality of frames and interconnects the plurality of frames by including a portion inserted into one of the plurality of frames, and including another portion inserted into the other one of the plurality of frames; and a light source arranged on the plurality of frames.

17 Claims, 6 Drawing Sheets

(51) Int. Cl.

| | |
|---|---|
| ***F21V 29/70*** | (2015.01) |
| ***F21V 29/83*** | (2015.01) |
| ***F21V 3/00*** | (2015.01) |
| ***F21V 17/10*** | (2006.01) |
| ***F21V 3/02*** | (2006.01) |
| *F21V 23/06* | (2006.01) |
| *F21V 29/506* | (2015.01) |
| *F21Y 103/10* | (2016.01) |
| *F21Y 115/10* | (2016.01) |
| *F21V 15/01* | (2006.01) |

(52) U.S. Cl.
CPC ..... *F21V 17/104* (2013.01); *F21V 17/108* (2013.01); *F21V 29/70* (2015.01); *F21V 29/83* (2015.01); *F21V 15/012* (2013.01); *F21V 23/06* (2013.01); *F21V 29/506* (2015.01); *F21Y 2103/10* (2016.08); *F21Y 2115/10* (2016.08)

(58) Field of Classification Search
CPC ..... F21V 3/00; F21V 17/104; F21V 17/108; F21V 29/506; F21V 23/06; F21Y 2115/10
See application file for complete search history.

(56) References Cited

U.S. PATENT DOCUMENTS 7,611,260 B1 * 11/2009 Lin ..... F21V 29/83 362/217.01
8,313,213 B2 * 11/2012 Lin ..... F21K 9/27 362/217.12
8,740,405 B2 * 6/2014 Yamazaki ..... F21S 2/00 362/223
9,958,114 B2 * 5/2018 Park ..... F21V 21/34
2003/0081413 A1 * 5/2003 Weedon ..... F21S 2/00 362/219
2005/0041419 A1 * 2/2005 Kazi ..... F21V 17/007 362/219
2012/0092875 A1 4/2012 Cho et al.
2013/0010459 A1 1/2013 Wilson
2013/0208475 A1 8/2013 Yu
2013/0223052 A1 8/2013 Simon et al.
2014/0177209 A1 6/2014 Carney et al.

FOREIGN PATENT DOCUMENTS

KR 101117554 B1 3/2012
WO WO 2011/139764 A2 11/2011

OTHER PUBLICATIONS

Written Opinion of the International Searching Authority dated Jan. 27, 2015 in connection with International Patent Application No. PCT/KR2014/009771, 7 pages.
Foreign Communication from Related Counterpart Application, European Patent Application No. 14854549.4, Supplementary European Search Report and European Search Opinion dated Apr. 7, 2017, 7 pages.
European Patent Office Communication regarding Application No. 14854549.4, dated Dec. 13, 2017, 4 pages.

* cited by examiner

LIGHTING APPARATUS AND LIGHTING SYSTEM

CROSS-REFERENCE TO RELATED APPLICATION(S) AND CLAIM OF PRIORITY

This application is a continuation of International Application No. PCT/KR2014/009771 filed on Oct. 17, 2014, which claims priority to Korean Patent Application No. 10-2013-0124656 filed on Oct. 18, 2013, each of which are hereby incorporated by reference into the present disclosure as if fully set forth herein.

TECHNICAL FIELD

One or more embodiments of the present invention relate to lighting apparatuses and lighting systems.

BACKGROUND

To replace fluorescent lamps that are being widely used, fluorescent lamp type LED lamps using light-emitting diodes featuring less power consumption and longer lifespan as light sources are becoming popular. Such a fluorescent lamp type LED lamp has a shape identical or similar to that of a fluorescent lamp in the related art for compatibility.

Such a fluorescent lamp type LED lamp generally employs a heat sink that is arranged as a single part inside a lamp cover. However, if heat sink is divided into two parts due to a structural reason or an operational reason or a plurality of LED lamps are connected, a gap or bending may occur at a portion interconnecting heat sinks.

SUMMARY

One or more embodiments of the present invention include a method for preventing a portion interconnecting heat sinks from gap formation or being curved.

Additional aspects will be set forth in part in the description which follows and, in part, will be apparent from the description, or may be learned by practice of the presented embodiments.

According to an aspect of the present invention, a lighting apparatus may include: a plurality of frames connected to each other in the lengthwise direction; a connector, which is arranged between the plurality of frames and interconnects the plurality of frames by including a portion inserted into one of the plurality of frames, and including another portion inserted into the other one of the plurality of frames; and a light source arranged on the plurality of frames.

Each of the plurality of frames may have a hollow structure with two opposite ends along the lengthwise direction, and open end portions of the frames face each other and are connected to each other.

The plurality of frames may be symmetrically arranged around the connector.

The connector has a cross-sectional shape corresponding to the plurality of frames and has a hollow structure.

The connector may comprise a locking unit detachably attached to the plurality of frames.

The locking unit may be arranged on at least one surface of the connector inserted into the plurality of frames and contacting the frames.

The locking units may be arranged at two opposite side around the center of the connector in the lengthwise direction.

The plurality of frames may comprise locking grooves to be combined with the locking units.

The plurality of frames and the connector may be formed of a same material.

The lighting apparatus may further comprise terminal units arranged at two opposite ends of the plurality of frames connected to each other.

The terminal units may comprise caps attached to two opposite open ends of the plurality of frames and electrode pins extending out of the caps.

The lighting apparatus may further comprise a cover, which is detachably attached to the plurality of frames and covers the light source.

The cover may comprise a plurality of guides protruding from inner side surfaces of the cover, and the plurality of frames may comprise guiding grooves extending on outer side surfaces of the plurality of frames in the lengthwise direction of the plurality of frames in correspondence to the plurality of guides.

The cover may comprise a plurality of heat dissipating slits or a plurality of heat dissipating holes.

According to another aspect of the present invention, a lighting system may include: a fixing structure; and a lighting apparatus, which is attached to the fixing structure and emits a light based on power supplied via the fixing structure.

According to the one or more of the above embodiments of the present invention, a lighting apparatus and a lighting system that may provide improved reliabilities by being prevented from gap formation or being curved at a connecting portion between heat sinks may be provided.

BRIEF DESCRIPTION OF THE DRAWINGS

These and/or other aspects will become apparent and more readily appreciated from the following description of the embodiments, taken in conjunction with the accompanying drawings in which.

DETAILED DESCRIPTION

Figure 1:
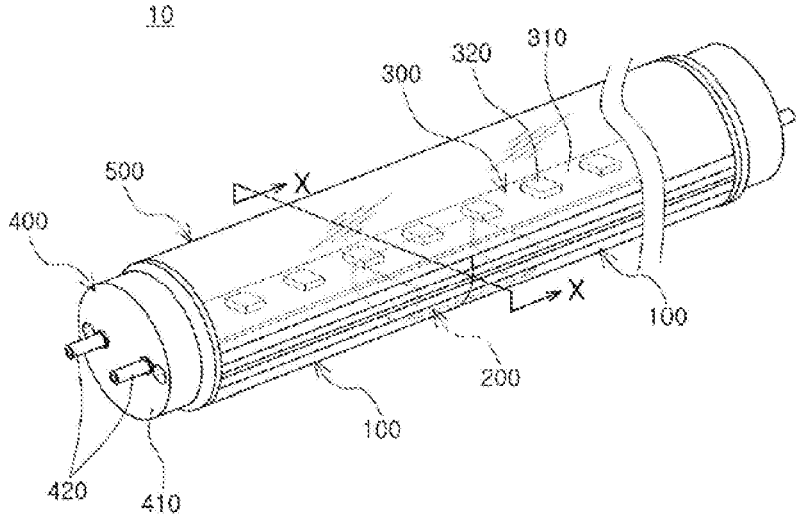
FIG. 1 is a schematic perspective view of the lighting apparatus according to an embodiment of the present invention.

Reference will now be made in detail to embodiments, examples of which are illustrated in the accompanying drawings, wherein like reference numerals refer to like elements throughout. In this regard, the present embodiments may have different forms and should not be construed as being limited to the descriptions set forth herein. Accordingly, the embodiments are merely described below, by referring to the figures, to explain aspects of the present description. In the drawings, the shape and the size of elements may be exaggerated for clarity.

Referring to FIG. 1, a lighting apparatus 10 according to an embodiment of the present invention will be described below. FIG. 1 is a schematic perspective view of the lighting apparatus 10 according to an embodiment of the present invention.

Referring to FIG. 1, the lighting apparatus 10 includes a plurality of frames 100 connected to each other, a connector 200 arranged between the plurality of frames 100 to interconnect the plurality of frames 100, and light sources 300 arranged on the frames 100 and may further include a terminal unit 400 and a cover 500.

The plurality of frames 100 are connected to each other in the lengthwise direction and constitute the basic skeleton of the lighting apparatus 10. Furthermore, size of the lighting apparatus 10 may be adjusted by adjusting the number of the frames 100. Although FIG. 1 shows that the two frames 100 are connected to each other, the present invention is not limited thereto. For example, the three or more frames 100 may be connected to one another. The number of the frames 100 may be variously changed.

Figure 2:
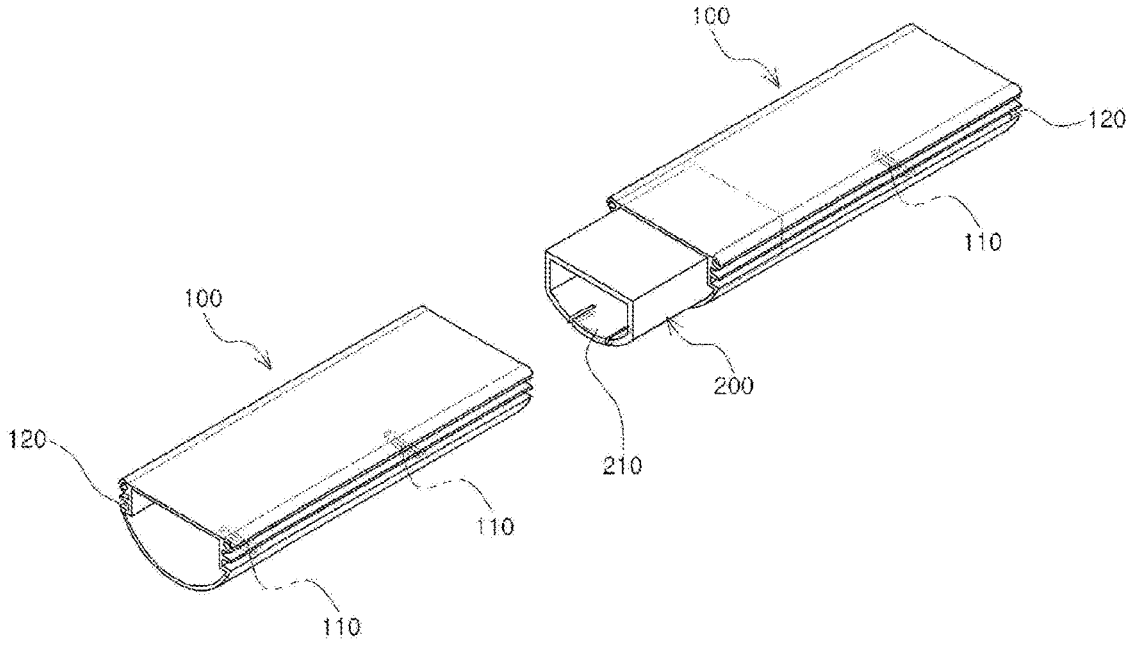
FIG. 2 is a schematic perspective view showing structure of the frame and connector of FIG. 1.
Figure 3:
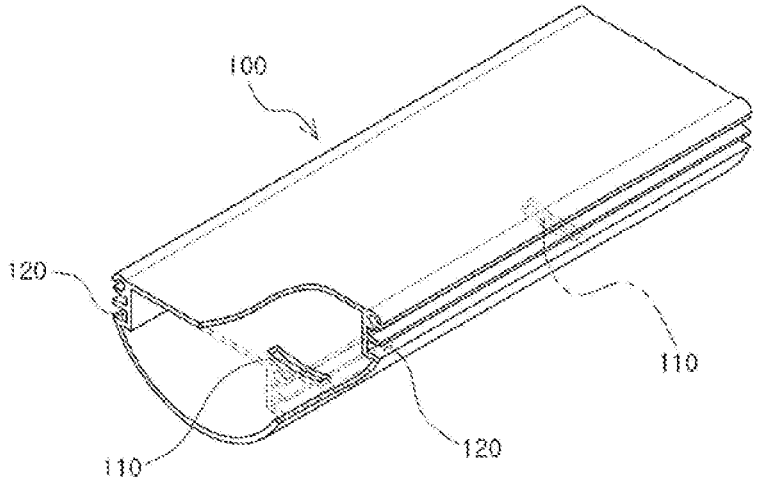
FIG. 3 is a schematic perspective view showing structure of the frame of FIG. 2.

The plurality of frames 100 may have structures having shapes corresponding to each other. FIGS. 2 and 3 are schematic diagrams showing structure of the frames 100.

As shown in FIGS. 2 and 3, each of the frames 100 may have a hollow pipe-like structure in which two opposite ends in the lengthwise direction are opened. Furthermore, the frames 100 may be connected to each other in the lengthwise direction, such that an open end of one of the frames 100 face an open end of another one of the frames 100. Therefore, the frames 100 may be symmetrical to each other around a connecting portion.

A surface of each of the plurality of frames 100 connected to each other may be an overall flat surface, so that the light source 300 may be arranged thereon as described below.

Locking grooves 110 may be formed at each of the plurality of frames 100. The locking grooves 110 may be formed nearby two opposite open ends of each of the frames 100. The locking groove 110 may be locked with the connector 200 as described below and a fixing force may be generated with respect to the connector 200.

Furthermore, each of the plurality of frames 100 may include guiding grooves 120 formed at the outer surfaces along the lengthwise direction. The guiding grooves 120 allow the cover 500 to be detachably locked as described below. The guiding grooves 120 may be formed at two side surfaces of each of the frames 100 facing each other. The guiding grooves 120 may be respectively arranged at two side surfaces of the plurality of frames 100 facing each other.

The plurality of frames 100 may be formed of various materials in consideration of heat dissipation characteristics and mechanical characteristics, e.g., aluminum (Al). Alternatively, the plurality of frames 100 may be formed of polycarbonate (PC). However, materials for forming the frames 100 are not limited thereto.

The connector 200 is arranged at where the plurality of frames 100 are connected to each other, so that the frame 100 are connected and fixed to each other.

In detail, as shown in FIG. 2, a portion of the connector 200 is inserted into one of the plurality of frames 100 and the other portion of the connector 200 inserted to the other one of the plurality of frames 100, thereby interconnecting the plurality of frames 100. In other words, halves of the connector 200 is inserted to the plurality of frames 100 contacting each other via end portions, so that the plurality of frames 100 are connected to each other. Furthermore, by mechanically reinforcing the connecting portions, the connecting portions may be prevented from gap formation or being curved.

The connector 200 may have a cross-sectional shape corresponding to the plurality of frames 100. However, the cross-section of the connector 200 is smaller than the frame 100, so that the connector 200 may be inserted into the frame 100 via an open end portion. Furthermore, the connector 200 may have a hollow structure. The hollow structure is advantageous in terms of weight and manufacturing process. Of course, the frame 100 may have a solid structure without an internal space.

Figure 4:
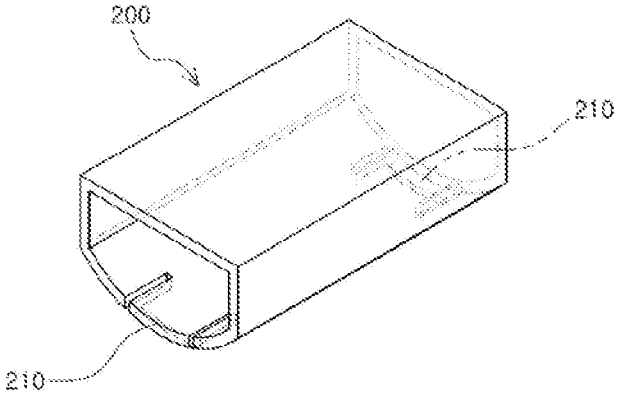
FIG. 4 is a schematic perspective view showing structure of the connector of FIG. 2.
Figure 5A:
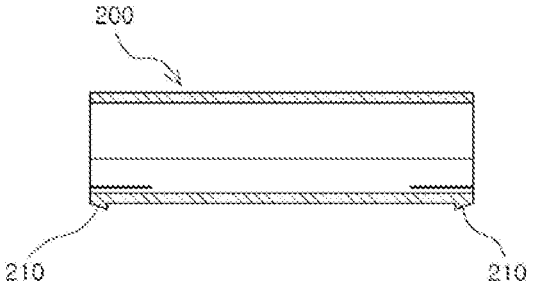
FIGS. 5*a* and 5*b* are schematic cross-sectional view and bottom view showing structure of the connector of FIG. 4.
Figure 5B:
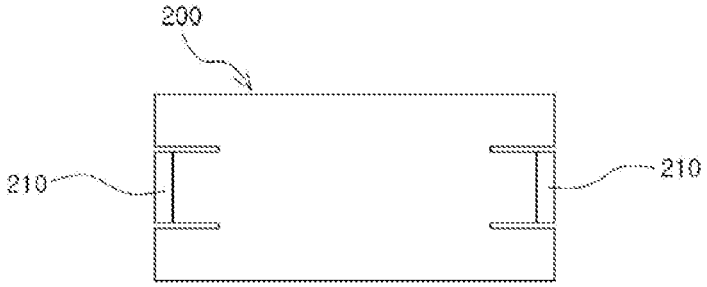

Meanwhile, the connector 200 may include a locking unit 210 detachably locked to the locking grooves 110 when the connector 200 is inserted into the plurality of frames 100. FIGS. 4 and 5 schematically show a connector including the locking unit. The locking unit 210 may include a hook, for example. Although the locking unit 210 is a hook in the present embodiment, the present invention is not limited thereto. For example, the locking unit 210 may have a combination structure including a guide boss.

Figure 6A:
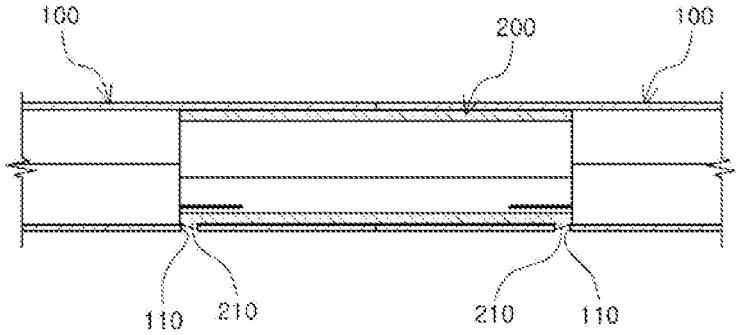
FIGS. 6*a* and 6*b* are schematic cross-sectional view and bottom view showing the connector combined with the frames.
Figure 6B:
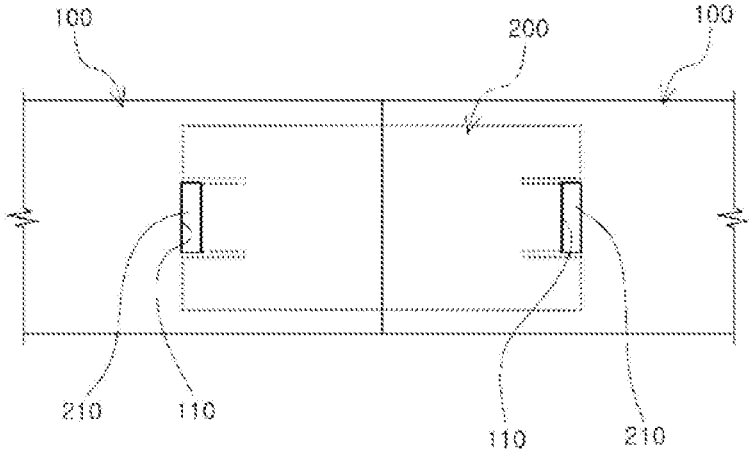

The locking unit 210 may have an elastic structure arranged on at least one of surfaces of the connector 200 contacting the plurality of frames 100 by being inserted thereto. Furthermore, the locking units 210 may be arranged at two opposite side of the connector 200 around the center of connector 200 in the lengthwise direction. Therefore, as shown in FIG. 6, when the connector 200 is inserted into the two horizontally arranged frames 100, the locking units 210 may be combined with and lock-fixed to locking grooves 210 arranged at the frames 100, respectively.

The connector 200 may be formed of a same material as the plurality of frames 100. For example, the connector 200 may be formed of a metal, such as aluminum (Al), or a resin material, such as a polycarbonate (PC) and poly methyl metacrylate (PMMA).

The plurality of frames 100 detachably connected to each other via the connector 200 as described above may constitute a heat sink, which corresponding to a base of the lighting apparatus 10. Furthermore, the frames 100 may be adjusted to be used in the lighting apparatus 10 having various sizes and structures by detaching or attaching the frames 100. Particularly, by reinforcing the connecting portions between the frames 100 by inserting the connector 200, the connecting portions may be prevented from gap formation or being curved.

The light source 300 may be arranged on the plurality of frames 100 corresponding to a heat sink and may be supported and fixed thereby. Furthermore, the light source 300 may emit a light based on power supplied from outside. The light source 300 may include a substrate 310 and a plurality of light-emitting devices 320 arranged on the substrate 310.

The substrate 310 may be a general FR4-type printed circuit board (PCB) and may be formed of an organic resin material containing epoxy, triazine, silicon, polyimide, etc. a ceramic material, such as silicon nitride, AlN, and Al2O3, a metal, or a metal compound and may contain MCPCB, MCCL, etc.

The light-emitting device 320 may be any of various photoelectric devices that emits a light of a designated wavelength based on a driving power applied from outside, where the most popular examples thereof may include a semiconductor light-emitting diode (LED) formed by epitaxial-growing a semiconductor layer on a growth substrate. The light-emitting device 320 may emit a blue light, a green light, or a red light based on materials contained therein and may also emit a white light.

Although not limited thereto, the light-emitting device 320 may have a stacked structure including an n-type semiconductor layer, a p-type semiconductor layer, and an active layer arranged therebetween, for example. Furthermore, the active layer may be a nitride semiconductor containing InxAlyGal-x-yN ($0 \le x \le 1$, $0 \le y \le 1$, $0 \le x+y \le 1$) having single or multi quantum well structure.

LED chips having various structures or various types of LED packages including such LED chips may be used for the light-emitting devices 320.

The substrate 310 may have a bar-like plate-type structure that extends in the lengthwise direction, like the plurality of frames 100. Of course, the structure and the shape of the substrate 310 may vary in correspondence to the structure of the lighting apparatus 10 according to the present embodiment.

Furthermore, the plurality of light-emitting devices 320 may be arranged at a designated interval in the lengthwise direction of the substrate 310. According to the present embodiment, the plurality of light-emitting devices 320 are arranged in a single column. However, the present invention is not limited thereto, and the plurality of light-emitting devices 320 may be arranged in a plurality of columns.

The terminal units 400 are arranged at two opposite end portion of each of the frames 100 and receive driving power from outside. The terminal unit 400 may include caps 410 attached to open end portions of the plurality of frames 100 connected to each other and electrode pins 420 extending out of the caps 410.

The caps 410 have a structure to be inserted into the open end portions of the frames 100 at two opposite ends and covers the open end portions of the frames 100. In other words, the cap 410 is an inner type and may function as a stopper.

An end of the electrode pin 420 penetrates through the cap 410 and extends to outside, whereas the other end of the electrode pin 420 extends into the frame 100 and may be electrically connected to the light source 300.

The cover 500 is detailed detachably attached to the frame 100 and covers the light source 300. The cover 500 may be formed of a light transmitting material, such that a light emitted from the light source 300 is widely emitted to outside. The cover 500 may be formed of a glass or a transparent or opaque resin. However, the present invention is not limited thereto.

The cover 500 covers the light source 300 and protects the light source 300 from outside environment and irradiates a light emitted from the light source 300 to a wide area by refracting the light. Furthermore, the cover 500 may include a light diffusing material for diffusion of a light. For example, the light diffusing material may include silicon dioxide ($SiO_2$), titanium dioxide ($TiO_2$), aluminum oxide ($Al_2O_3$), etc.

Figure 7:
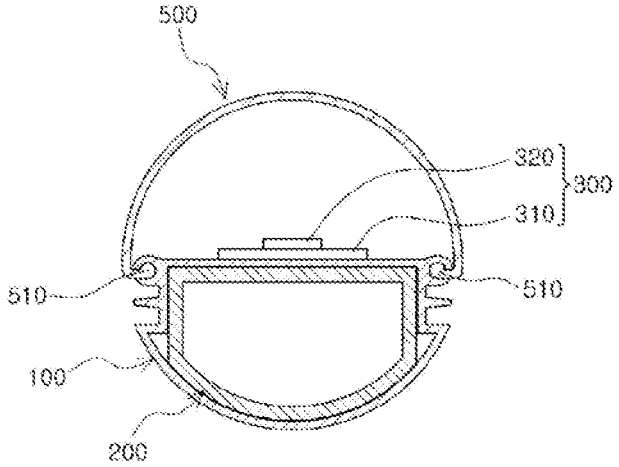
FIG. 7 is a schematic cross-sectional view showing a state taken along X-X axis in the lighting apparatus of FIG. 1.

As shown in FIG. 7, the cover 500 may include a plurality of guides 510 protruding from inner side surfaces of the cover 500. The plurality of guides 510 are formed to face each others and may extend in the lengthwise direction of the cover 500. The plurality of guides 510 are detachably inserted into the guiding grooves 120 arranged on the outer side surfaces of the plurality of frames 100 to fix the cover 500 to the frame 100.

Figure 8:
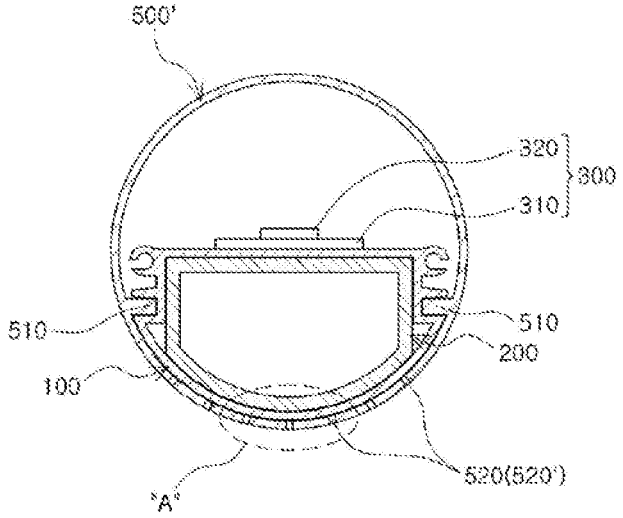
FIG. 8 is a schematic view of a modified embodiment of FIG. 7.

FIG. 8 is a schematic view of a modified embodiment of the cover 500. A cover 500' according to the modified embodiment shown in FIG. 8 may have a hollow cylindrical pipe-liked structure having a circular cross sectional shape, unlike the cover 500 having a semicircular cross-sectional shape in the embodiment shown in FIG. 7.

The cover 500' accommodates the 100 in a space inside the cover 500' and may be attached to the frame 100. For example, while the guiding grooves 120 arranged at the frame 100 and the plurality of guides 510 are interlocked with each others, the frame 100 may slide into or out of the cover 500'. Therefore, unlike the embodiment shown in FIG. 7 in which the frame 100 is directly exposed to outside, the frame 100 may be accommodated inside the cover 500' and may not be exposed to outside.

As described above, the structure in which the cover 500' surrounds the frame 100 may enable a user to handle the lighting apparatus 10 more stably. For example, a user may not directly contact the frame 100 at a high temperature, thereby preventing the user from getting scalded.

Figure 9:
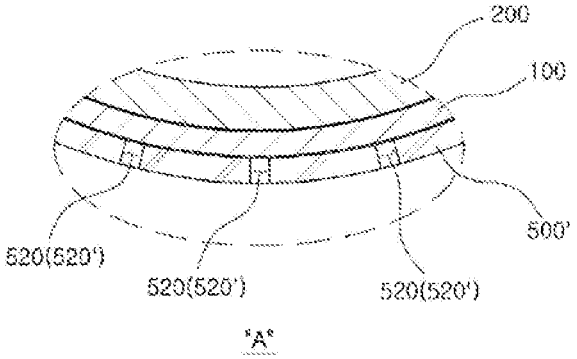
FIG. 9 is an enlarged cross-sectional view of portion A of FIG. 8.

Meanwhile, as shown in FIG. 9, the cover 500' may include a plurality of heat dissipating slits 520 or a plurality of heat dissipating holes 520' which partially expose the frame 100, at a portion contacting the frame 100. The plurality of heat dissipating slits 520 or the plurality of heat dissipating holes 520' may be formed to penetrate the cover 500'. The plurality of heat dissipating slits 520 or the plurality of heat dissipating holes 520' may be formed and arranged along the lengthwise direction of the cover 500'.

The heat dissipating holes 520' or the heat dissipating slits 520 allows heat generated by the light source 300 and transmitted to the frame 100 to be discharged to outside more quickly.

Figure 10:
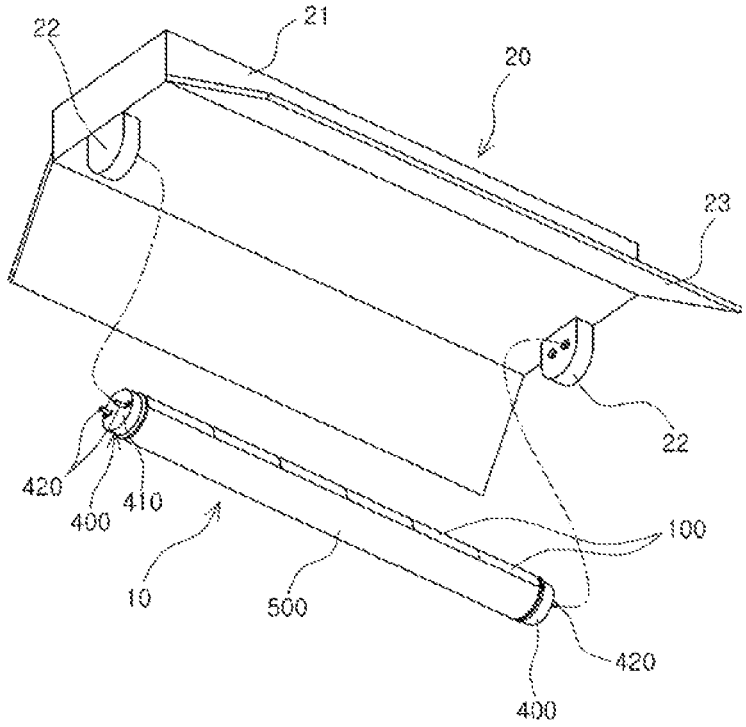
FIG. 10 is a schematic perspective view of a lighting system employing the lighting apparatus of FIG. 1.

FIG. 10 is a schematic view of a lighting system 1 employing the lighting apparatus 10.

As shown in FIG. 10, the lighting system 1 may include the lighting apparatus 10 and a fixing structure 20 on which the lighting apparatus 10 is mounted.

The fixing structure 20 may include a body 21 and at least one pair of sockets 22 arranged at the body 21.

When the lighting apparatus 10 is mounted on the fixing structure 20, the terminal units 400 may be physically and electrically combined with the pair of sockets 22 arranged at two opposite end portions of the body 21 via the electrode pins 420. Furthermore, a driving power may be supplied to the light source 300 via the pair of sockets 22.

A power supply unit (PSU) (not shown) is arranged at the body 21 and may stably supply driving power from outside. Furthermore, the body 21 may further include a reflector 23.

The fixing structure 20 may be fixed to the ceiling or a wall inside a building. Furthermore, the fixing structure 20 may be arranged at a large advertisement panel screen.

Meanwhile, the lighting apparatuses using LEDs may be categorized into indoor lighting apparatuses and outdoor lighting apparatus based on purposes. Indoor LED lighting apparatuses are generally retrofits and may include a lamp, a fluorescent lamp (LED-tube), and a flat-panel type lighting apparatus. On the other hand, outdoor LED lighting apparatuses may include a street light, a security light, a spotlight, a police light, a traffic light, etc.

Furthermore, LED lighting apparatuses may be applied to light sources used by robots and various machine equipments. Particularly, a LED light using a special wavelength band may accelerate growth of a plant and may emotionally stabilize or cure a man as an emotion lighting device.

As described above, according to the one or more of the above embodiments of the present invention, a lighting apparatus and a lighting system that may provide improved reliabilities by being prevented from gap formation or being curved at a connecting portion between heat sinks may be provided.

It should be understood that the exemplary embodiments described therein should be considered in a descriptive sense only and not for purposes of limitation. Descriptions of features or aspects within each embodiment should typically be considered as available for other similar features or aspects in other embodiments.

While one or more embodiments of the present invention have been described with reference to the figures, it will be understood by those of ordinary skill in the art that various changes in form and details may be made therein without departing from the spirit and scope of the present invention as defined by the following claims.

What is claimed is:

1. A lighting apparatus comprising:

a plurality of frames coupled to each other in a lengthwise direction;

a connector, which is arranged between the plurality of frames and interconnects the plurality of frames by including a portion inserted into one of the plurality of frames, and including another portion inserted into another one of the plurality of frames;

a light source coupled to each of the plurality of frames; and a single cover detachably coupled to each of the plurality of frames, wherein the single cover covers the light source; and wherein the single cover comprises a plurality of heat dissipating slits or a plurality of heat dissipating holes, and wherein the plurality of heat dissipating slits or the plurality of heat dissipating holes expose the plurality of frames to an outside and are arranged along the lengthwise direction of the single cover.

2. The lighting apparatus of claim 1, wherein each of the plurality of frames comprises a closed tube that is hollow and has two opposite ends along the lengthwise direction, and open end portions of the plurality of frames face each other and are coupled to each other with the connector.

3. The lighting apparatus of claim 1, wherein the plurality of frames are symmetrically arranged with respect to the connector by inserting the connector into adjacent ones of the frames in the lengthwise direction.

4. The lighting apparatus of claim 1, wherein the connector is a closed tube that is hollow and has an exterior with a cross-sectional shape that is complementary to interiors of the plurality of frames.

5. The lighting apparatus of claim 1, wherein the connector comprises a locking unit detachably attached to at least two of the plurality of frames.

6. The lighting apparatus of claim 5, wherein the locking unit comprises locking units, each of which is located adjacent an end of the connector and inserted into a respective one of the plurality of frames and engages said respective one of the plurality of frames.

7. The lighting apparatus of claim 6, wherein the locking units are on opposite ends of the connector, and the locking units are located at a lateral center of the connector with respect to the lengthwise direction.

8. The lighting apparatus of claim 7, wherein each of the plurality of frames comprises a locking groove that receives one of the locking units.

9. The lighting apparatus of claim 1, wherein the plurality of frames and the connector are formed of a same material.

10. The lighting apparatus of claim 1, further comprising terminal units located at two opposite ends of the coupled plurality of frames.

11. The lighting apparatus of claim 10, wherein the terminal units comprise caps coupled to the two opposite ends of the coupled plurality of frames, and each cap comprises electrode pins extending therefrom.

12. The lighting apparatus of claim 1, wherein the single cover comprises a plurality of guides protruding from inner side surfaces of the single cover, and the plurality of frames comprise guide grooves extending on outer side surfaces of the plurality of frames in the lengthwise direction, and the guide grooves are complementary in shape to respective ones of the plurality of guides.

13. The lighting apparatus of claim 1, wherein the light source comprises a plurality of light emitting diodes (LEDs).

14. A lighting system comprising:

a fixing structure; and a lighting apparatus configured to be attached to the fixing structure and configured to emit light based on power supplied via the fixing structure, wherein the lighting apparatus comprises:

a plurality of frames coupled to each other in a lengthwise direction, and each of the plurality of frames comprises a closed tube that is hollow and has two opposite ends along the lengthwise direction;

a connector, which is arranged between the plurality of frames and interconnects the plurality of frames by including a portion inserted into one of the plurality of frames, and including another portion inserted into another one of the plurality of frames;

a light source coupled to the plurality of frames; and a single cover detachably coupled to each of the plurality of frames, wherein the single cover covers the light source; and wherein the single cover comprises a plurality of heat dissipating slits or a plurality of heat dissipating holes, wherein the plurality of heat dissipating slits or the plurality of heat dissipating holes expose the plurality of frames to an outside and are arranged along the lengthwise direction of the single cover.

15. The lighting system of claim 14, wherein the plurality of frames are symmetrically arranged with respect to the connector by inserting the connector into adjacent ones of the frames in the lengthwise direction.

16. The lighting system of claim 14, wherein the connector is a closed tube that is hollow and has an exterior with a cross-sectional shape that is complementary to interiors of the plurality of frames.

17. A lighting system comprising:

a light fixture having an axis; and a lamp configured to be mounted to the fixture and configured to emit light in response to power supplied from the fixture, wherein the lamp comprises:

frames coupled to each other in an axial direction;

a connector comprising a closed tube that is hollow, wherein the connector is axially inserted into the frames to interconnect the frames; and a light source comprising light emitting diodes (LEDs) coupled to the frames, a single cover detachably coupled to each of the frames, and the single cover covers the light source, wherein the single cover comprises a plurality of heat dissipating slits or a plurality of heat dissipating holes, and wherein the plurality of heat dissipating slits or the plurality of heat dissipating holes expose the frames to an outside and are arranged along a lengthwise direction of the single cover.

* * * * *